US008643688B1

(12) United States Patent
Chen et al.

(10) Patent No.: US 8,643,688 B1
(45) Date of Patent: Feb. 4, 2014

(54) PRINTING DEVICE

(71) Applicant: Primax Electronics Ltd., Taipei (TW)

(72) Inventors: Yi-Liang Chen, Taipei (TW); Wen-Hsien Yen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 13/749,363

(22) Filed: Jan. 24, 2013

(30) Foreign Application Priority Data

Sep. 14, 2012 (TW) ..... 101133740 A

(51) Int. Cl.
*B41J 17/30* (2006.01)
*B41J 32/00* (2006.01)

(52) U.S. Cl.
USPC ..... 347/217; 347/214

(58) Field of Classification Search
USPC ..... 347/171, 214, 215, 217, 218, 222
See application file for complete search history.

(56) References Cited

U.S. PATENT DOCUMENTS

| | | | | |
|---|---|---|---|---|
| 5,451,984 | A * | 9/1995 | Takamiya et al. | 347/217 |
| 6,600,505 | B2 * | 7/2003 | Soshi | 347/217 |
| 6,650,351 | B2 * | 11/2003 | Yamamoto et al. | 347/214 |
| 7,450,141 | B2 * | 11/2008 | Yamamoto | 347/214 |
| 7,808,518 | B2 * | 10/2010 | Nakai et al. | 347/214 |
| 2005/0024471 | A1 * | 2/2005 | Okuie et al. | 347/214 |
| 2005/0052523 | A1 * | 3/2005 | Kaida et al. | 347/214 |

* cited by examiner

*Primary Examiner* — Kristal Feggins
(74) *Attorney, Agent, or Firm* — Evan R. Witt; Kirton McConkie

(57) ABSTRACT

A printing device includes a casing, an upper cover, plural light sources, and a sensing module. The plural light sources are used for emitting plural light beams. The upper cover is connected with the casing, and rotatable relative the casing. The plural light sources are disposed on the upper cover, and arranged in a row. The sensing module is disposed under the plural light sources, and movable relative to the casing along a specified direction. After the light beams transmitted through a gap of the transfer paper are received by the sensing module, the gap is detected by the sensing module. The plural light beams emitted by the plural light sources can be projected onto any movable position of the sensing module. In other words, it is not necessary to align the sensing module and the plural light beams.

10 Claims, 9 Drawing Sheets

PRINTING DEVICE

FIELD OF THE INVENTION

The present invention relates to a printing device, and more particularly to a thermal transfer printing device using a thermal transfer printing technology.

BACKGROUND OF THE INVENTION

Printing devices are peripherals for printing characters and/or graphics on papers or other kinds of printing media. Generally, the printing devices are classified into two types: i.e. ordinary printing devices and thermal transfer printing devices. The configurations of the thermal transfer printing devices are substantially identical to those of the ordinary printing devices except for the printing way. For example, the ordinary printing device supplies ink or toner onto a paper. Whereas, the thermal transfer printing device has a thermal print head (TPH) to heat a ribbon and allow the coating of the ribbon to be adsorbed on a transfer paper, so that the image is printed out. The widely-used thermal transfer printing devices include for example faxing machines, POS (Point of Sale) printers and barcode printers.

Recently, a thermal transfer printing device has been introduced into the market. Hereinafter, the structure of a conventional thermal transfer printing device will be illustrated with reference to FIGS. 1 and 2. FIG. 1 is a schematic side view illustrating a conventional thermal transfer printing device. FIG. 2 is a schematic side view illustrating the conventional thermal transfer printing device of FIG. 1 and taken along another viewpoint. As shown in FIGS. 1 and 2, the conventional thermal transfer printing device 1 comprises a casing 10, a thermal transfer printing module 11, a first power device 12, a first gear set 13, a second power device 14, a second gear set 15, a third power device 16, a transmission mechanism 17, and a controlling unit 18. The thermal transfer printing module 11 comprises a ribbon transporting module 111, a transfer paper transporting module 112, a thermal print head 113, and a print roller 114. A ribbon R of the ribbon transporting module 111 is transported through the region between the thermal print head 113 and the print roller 114. A transfer paper M of the transfer paper transporting module 112 is also transported through the region between the thermal print head 113 and the print roller 114. The transfer paper M comprises a releasing paper part M1 and plural medium parts M2. The plural medium parts M2 are disposed over the releasing paper part M1. Every two adjacent medium parts M2 are separated from each other by a gap G. The thermal print head 113 is used for heating the ribbon R to allow the coating of the ribbon R to be adsorbed on the medium parts M2 of the transfer paper M. Consequently, a thermal transfer printing operation is performed to print the medium parts M2 as documents M3. The print roller 114 is used for transporting the ribbon R and the transfer paper M and facilitating the thermal print head 113 to stably perform the thermal transfer printing operation.

As shown in FIG. 1, the ribbon transporting module 111 comprises a ribbon supplying terminal 1111, a ribbon recovering terminal 1112, a first tension shaft 1113, and a second tension shaft 1114. The ribbon R is stored in the ribbon supplying terminal 1111. An end of the ribbon R is wound around and fixed on the ribbon recovering terminal 1112. The first tension shaft 1113 and the second tension shaft 1114 are used for providing tension forces to the ribbon R. As the ribbon recovering terminal 1112 is driven to be rotated, the ribbon R is transmitted from the ribbon supplying terminal 1111 to the ribbon recovering terminal 1112. The transfer paper transporting module 112 comprises a transfer paper supplying terminal 1121, a transfer paper recovering terminal 1122, a third tension shaft 1123, and a fourth tension shaft 1124. The configurations and functions of the transfer paper transporting module 112 are very similar to those of the ribbon transporting module 111. The transfer paper M is stored in the transfer paper supplying terminal 1121. An end of the transfer paper M is wound around and fixed on the transfer paper recovering terminal 1122. The third tension shaft 1123 and the fourth tension shaft 1124 are used for providing tension forces to the transfer paper M. As the transfer paper recovering terminal 1122 is driven to be rotated, the transfer paper M is transmitted from the transfer paper supplying terminal 1121 to the transfer paper recovering terminal 1122.

The relative positions of the components as shown in FIGS. 1 and 2 will be illustrated as follows. The first gear set 13 is connected with the ribbon recovering terminal 1112. The second gear set 15 is connected with the transfer paper recovering terminal 1122. The transmission mechanism 17 is connected with the print roller 114. The first power device 12 is connected with the first gear set 13 for providing motive power to the first gear set 13 in order to drive rotation of the ribbon recovering terminal 1112. The second power device 14 is connected with the second gear set 15 for providing motive power to the second gear set 15 in order to drive rotation of the transfer paper recovering terminal 1122. In addition, the third power device 16 is connected with the transmission mechanism 17 for providing motive power to the transmission mechanism 17 in order to drive rotation of the print roller 114. For example, the first power device 12, the second power device 14 and the third power device 16 are motors. The controlling unit 18 is connected with the first power device 12, the second power device 14 and the third power device 16 for enabling or disabling the first power device 12, the second power device 14 and the third power device 16.

During operations of the thermal transfer printing device 1, the first power device 12, the second power device 14 and the third power device 16 are driven by the controlling unit 18. Consequently, the ribbon R is transmitted from the ribbon supplying terminal 1111 to the ribbon recovering terminal 1112, and the transfer paper M is transmitted from the transfer paper supplying terminal 1121 to the transfer paper recovering terminal 1122. At the same time, the print roller 114 is rotated. When the transfer paper M is transported through the region between the thermal print head 113 and the print roller 114, the thermal print head 113 performs a thermal transfer printing operation. Consequently, the medium part M2 of the transfer paper M is printed as the document M3. As the print roller 114 and the transfer paper recovering terminal 1122 are continuously rotated, the releasing paper part M1 is detached from the document M3. The releasing paper part M1 is transmitted to the transfer paper recovering terminal 1122, but the document M3 is ejected out of the casing 10. Meanwhile, the thermal transfer printing operation is completed.

Before the thermal transfer printing operation is performed on the transfer paper M, a sensing module (not shown) is employed to detect the position of the gaps G of the transfer paper M in order to judge whether the blank medium part M2 is close to the thermal print head 113 and ready to be printed. A conventional sensing module for detecting the gaps G of the transfer paper M is disclosed in U.S. Pat. No. 6,396,070 for example.

FIG. 3 is a schematic perspective view illustrating two sensing modules of a conventional thermal transfer printing device disclosed in U.S. Pat. No. 6,396,070. In FIG. 3, a casing 92, an upper cover 100, a base 102, a first sensing module 10*a* and a second sensing module 10*b* of the conventional thermal transfer printing device are shown. The first sensing module 10*a* is disposed on the upper cover 100. The second sensing module 10*b* is disposed on the base 102. The upper cover 100 is rotatable relative to the base 102. Consequently, the first sensing module 10*a* may be rotated to a position over the second sensing module 10*b*.

During the process of detecting the gap G of the transfer paper M by the first sensing module 10*a* and the second sensing module 10*b*, the first sensing module 10*a* is served as a light source, and the second sensing module 10*b* is served as an optical sensing element. Before the gap G of the transfer paper M is detected, the position of the second sensing module 10*b* should be moved according to the size of the transfer paper M, so that the transfer paper M can be effectively detected. Of course, as the second sensing module 10*b* is moved, the position of the first sensing module 10*a* should be correspondingly changed, so that the first sensing module 10*a* is disposed over the second sensing module 10*b*.

The first sensing module 10*a* is used for emitting a light beam. When the transfer paper M is transmitted to the region between the first sensing module 10*a* and the second sensing module 10*b*, the light beam is transmitted through the transfer paper M and received by the second sensing module 10*b*. Consequently, the gap G of the transfer paper M can be detected by the first sensing module 10*a* and the second sensing module 10*b*.

However, during operations of the first sensing module 10*a* and the second sensing module 10*b*, the second sensing module 10*b* is firstly moved to a detecting position, and then the first sensing module 10*a* is moved to a region over the detecting position. Consequently, the first sensing module 10*a* is aligned with the second sensing module 10*b*. In other words, the first sensing module 10*a* should be precisely aligned with the second sensing module 10*b*, so that the light beam from the first sensing module 10*a* can be received by the second sensing module 10*b*. Moreover, for detecting the transfer paper M, the task of aligning the first sensing module 10*a* with the second sensing module 10*b* should performed as carefully as possible. The design of the conventional thermal transfer printing device is not user-friendly.

Therefore, there is a need of providing an easy-to-use printing device.

SUMMARY OF THE INVENTION

The present invention provides an easy-to-use printing device.

In accordance with an aspect of the present invention, there is provided a printing device for printing an image on a transfer paper and outputting the transfer paper along a first direction. The printing device includes a casing, an upper cover, plural light sources, and a sensing module. The casing is used for accommodating the transfer paper. The transfer paper includes a releasing paper part and plural medium parts, wherein every two adjacent medium parts are separated from each other by a gap. The upper cover is connected with the casing. The upper cover is rotatable relative the casing, so that the casing is selectively covered or uncovered by the upper cover. The plural light sources are disposed on the upper cover and arranged in a row for emitting plural light beams. The plural light sources are arranged along a second direction, which is perpendicular to the first direction. The plural light sources are arranged from an edge of an inner surface of the upper cover to a position beyond a middle point of the inner surface. The sensing module is disposed under the plural light sources and movable relative to the casing along the second direction. After the light beams transmitted through the gap are received by the sensing module, the gap is detected by the sensing module.

In an embodiment, the casing includes an output platform, an elongated slot, and a slide guiding body. The output platform is located near an end of the casing. The elongated slot is located at the output platform. The slide guiding body is disposed under the elongated slot for supporting the sensing module, so that the sensing module is inserted into the elongated slot. The slide guiding body includes a guiding track extended along the second direction. The guiding track is contacted with the sensing module for guiding movement of the sensing module along the second direction.

In an embodiment, the sensing module includes a sensor housing, a circuit board, and a sensing element. The sensor housing includes a lower part and a first opening. The lower part of the sensor housing is contacted with the guiding track. The first opening is located at a top surface of the sensor housing. The circuit board is disposed within the sensor housing and fixed on the sensor housing. The sensing element is disposed on the circuit board and exposed to the first opening. After the plural light beams are transmitted through the gap and the first opening, the plural light beams are received by the sensing element.

In an embodiment, the sensor housing includes a fixing post, and the circuit board includes a second opening. The sensing module further includes a protective plate and a cushioning element. The protective plate is disposed on the sensor housing and covers the first opening, thereby protecting the sensing element. The cushioning element is disposed under the circuit board and includes a third opening. When a depressing force is exerted on the sensor housing, the depressing force is buffered by the cushioning element, and the cushioning element is compressed and subjected to deformation, so that the sensor housing is moved downwardly relative to the slide guiding body. The fixing post of the sensor housing is penetrated through the second opening and the third opening, so that the circuit board and the cushioning element are fixed on the sensor housing.

In an embodiment, the protective plate is a light-transmissible Mylar sheet, and the cushioning element is a foam cushion.

In an embodiment, the circuit board includes a controlling unit, which is connected with the sensing element. A predetermined light intensity range is stored in the controlling unit. After the plural light beams are received by the sensing element, the sensing element issues a light intensity value to the controlling unit. By realizing whether the light intensity value is within the predetermined light intensity range, the controlling unit judges whether the gap of the transfer paper is detected. If the light intensity value is within the predetermined light intensity range, the controlling unit judges that the gap of the transfer paper is detected. Whereas, if the light intensity value is beyond the predetermined light intensity range, the controlling unit judges that the gap of the transfer paper is not detected.

In an embodiment, the casing further includes at least one stopping element. The at least one stopping element is located at a side of the elongated slot for stopping the sensing module, thereby preventing detachment of the sensing module from the elongated slot.

In an embodiment, the sensing module includes a sensor housing. A lower part of the sensor housing is contacted with the guiding track and movable along the second direction. The sensor housing includes at least one protrusion block, which is externally protruded from the sensor housing. The at least one protrusion block is contacted with the at least one stopping element, so that the at least one protrusion block is stopped by the at least one stopping element.

In an embodiment, the at least one protrusion block includes a first rack structure, which is disposed on a top surface of the at least one protrusion block. The at least one stopping element includes a second rack structure, which is disposed on an inner surface of the at least one stopping element and extended along the second direction. When the at least one protrusion block is stopped by the at least one stopping element, the first rack structure and the second rack structure are engaged with each other, so that the sensor housing is fixed.

In an embodiment, the sensing module further includes a cushioning element, and the cushioning element is disposed within the sensor housing. When a depressing force is exerted on the sensor housing, the cushioning element is compressed and subjected to deformation, the sensor housing is moved downwardly relative to the slide guiding body, and the first rack structure is disengaged from the second rack structure, so that the sensor housing is moved relative to the casing along the second direction. When the depressing force exerted on the sensor housing is eliminated, the deformed cushioning element is restored to an original shape, the sensor housing is moved upwardly relative to the slide guiding body, and the first rack structure is engaged with the second rack structure, so that the sensor housing is fixed.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks encountered from the prior art, the present invention provides a printing device.

Figure 1:
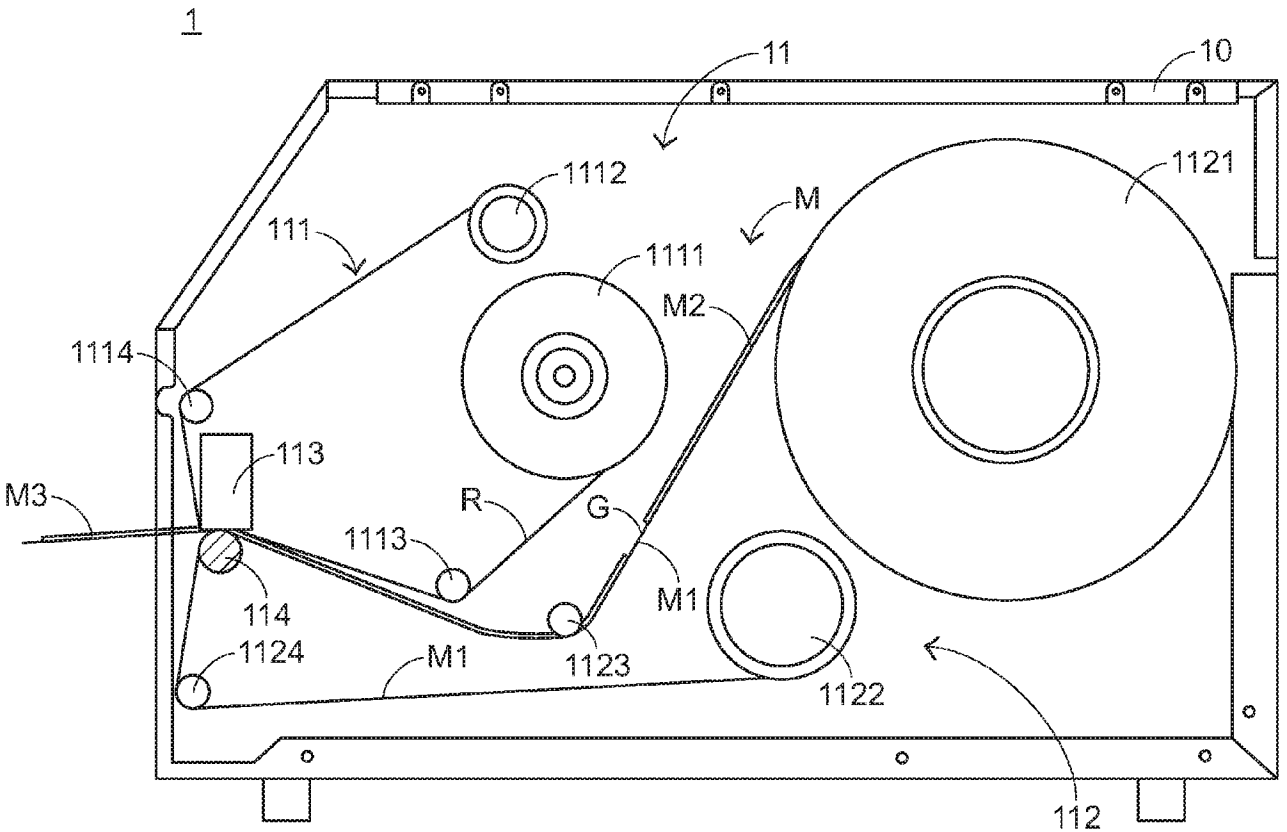
FIG.1 PRIOR ART
FIG. 1 is a schematic side view illustrating a conventional thermal transfer printing device.
Figure 2:
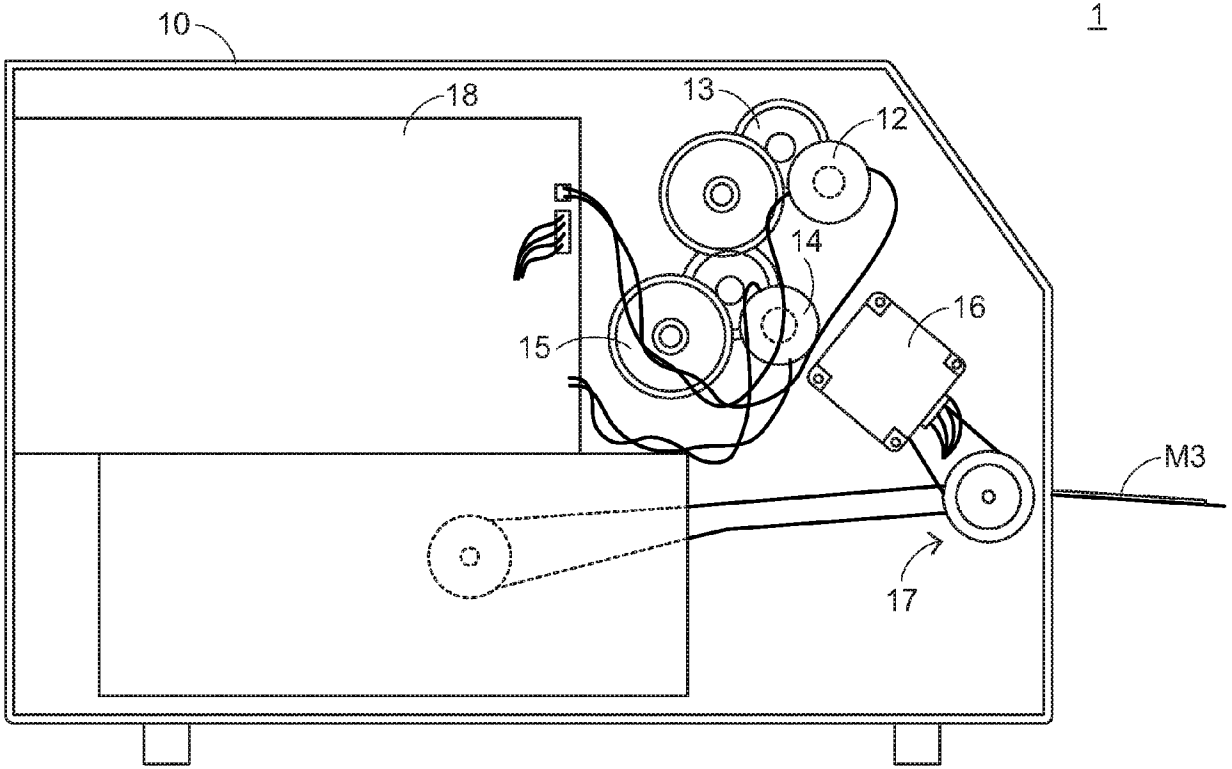
FIG.2 PRIOR ART
FIG. 2 is a schematic side view illustrating the conventional thermal transfer printing device of FIG. 1 and taken along another viewpoint.
Figure 3:
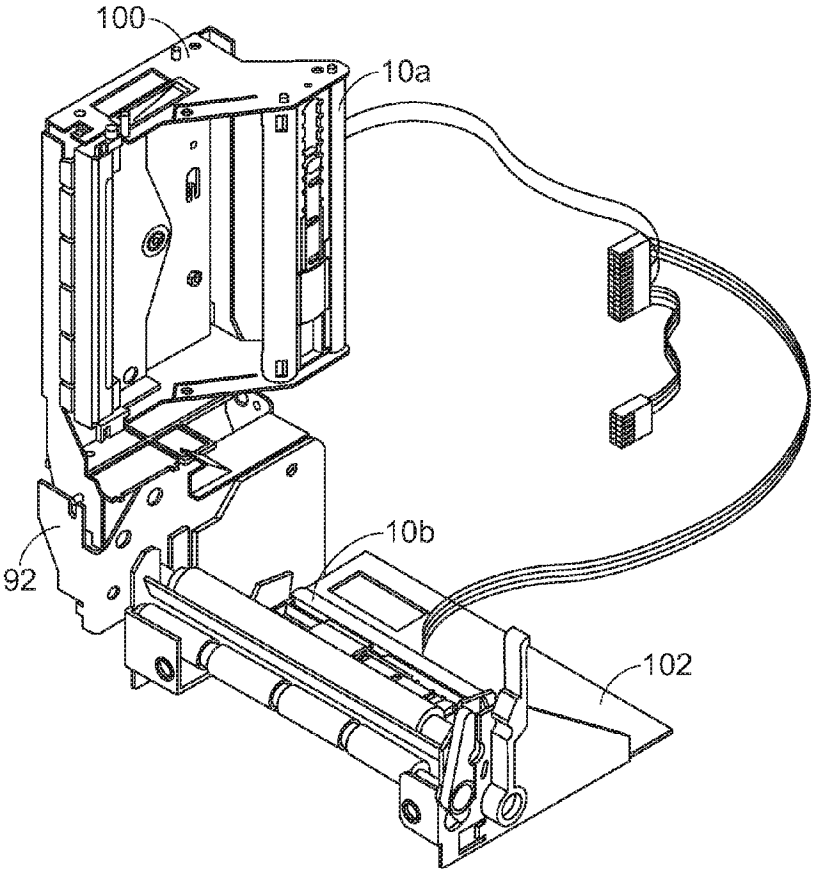
FIG.3 PRIOR ART
FIG. 3 is a schematic perspective view illustrating two sensing modules of a conventional thermal transfer printing device.
Figure 4:
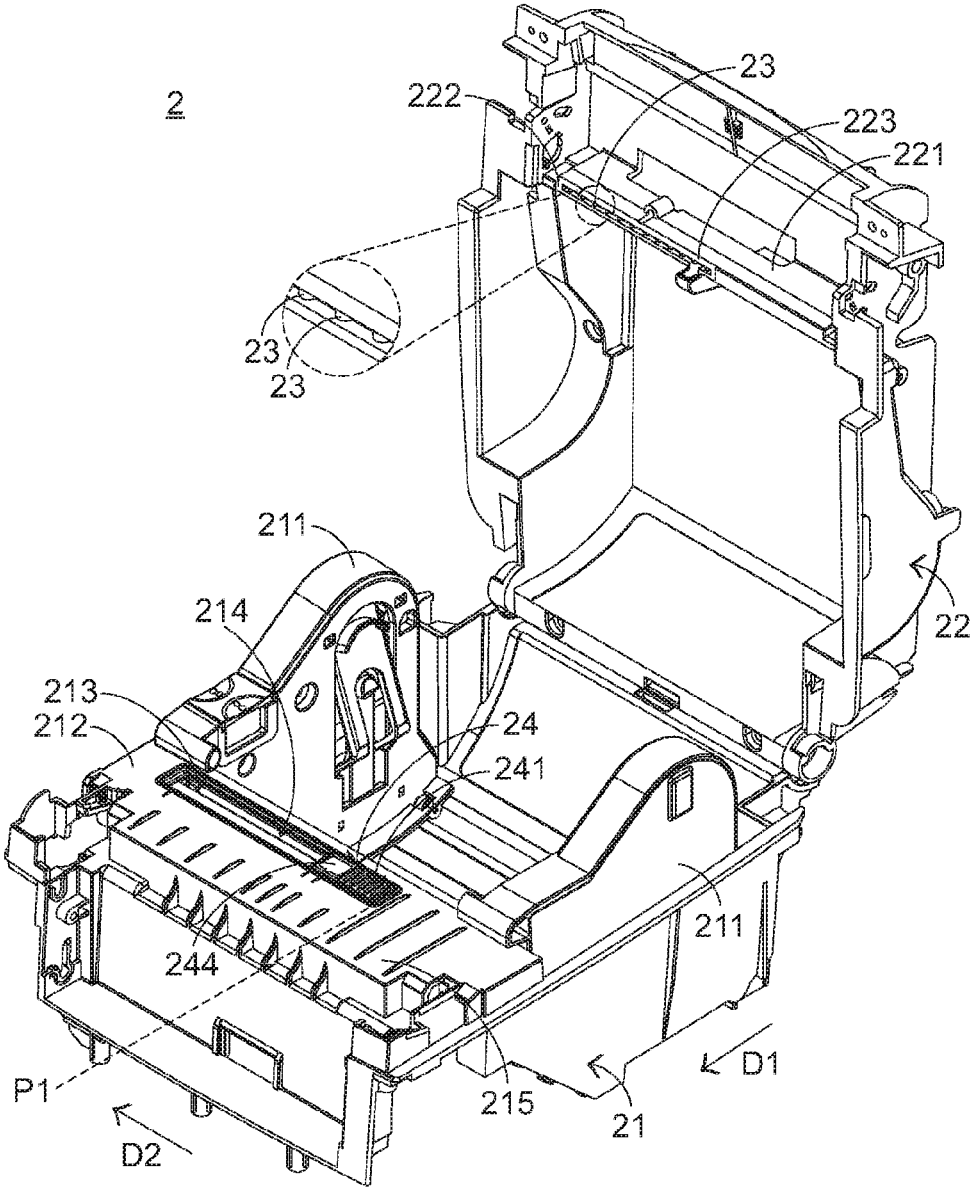
FIG. 4 is a schematic perspective view illustrating a printing device according to an embodiment of the present invention, in which an upper cover of the printing device is opened.

FIG. 4 is a schematic perspective view illustrating a printing device according to an embodiment of the present invention, in which an upper cover of the printing device is opened. The printing device 2 is used for printing an image on a transfer paper M* (see FIG. 9) and outputting the transfer paper M* along a first direction D1. The transfer paper M* comprises a releasing paper part M1* and plural medium parts M2*. Every two adjacent medium parts M2* are separated from each other by a gap G*. That is, the gap G* is arranged between every two adjacent medium parts M2*, and disposed over the releasing paper part M1*. The printing device 2 comprises a casing 21, an upper cover 22, plural light sources 23, and a sensing module 24. The other components of the printing device 2 are similar to those of the conventional thermal transfer printing device, and are not redundantly described herein. The transfer paper M* is wound as a paper roll (not shown), and disposed within the casing 21. The casing 21 comprises two supporting parts 211, an output platform 212, an elongated slot 213, and a slide guiding body 214. The two supporting parts 211 are used for supporting the transfer paper M* thereon. The output platform 212 is located near a rear end 215 of the casing 21. From FIG. 4, it is understood that the transfer paper M* is located between the two supporting parts 211 and may be outputted from the output platform 212 along the first direction D1. The elongated slot 213 is located at the output platform 212. The slide guiding body 214 is disposed under the elongated slot 213 for supporting the sensing module 24. Consequently, the sensing module 24 is inserted into the elongated slot 213.

Please refer to FIG. 4 again. The upper cover 22 is connected with the casing 21. Moreover, the upper cover 22 may be rotated relative to the casing 21, so that the casing 21 is selectively covered or uncovered by the upper cover 22. In a case that the casing 21 is not covered by the upper cover 22, the transfer paper M* is exposed and may be replaced with a new one. The plural light sources 23 are disposed on the upper cover 22 and arranged in a row. The plural light sources 23 are used for emitting plural light beams B (see FIG. 9). In this embodiment, the plural light sources 23 are arranged along a second direction D2, wherein the second direction D2 is perpendicular to the first direction D1. Moreover, the plural light sources 23 are arranged on the upper cover 22 from an edge 222 of an inner surface 221 of the upper cover 22 to a position beyond a middle point 223 of the inner surface 221. For example, the plural light sources 23 comprise plural light emitting diodes, plural laser diodes or a light emitting diode array with plural light emitting diodes. The sensing module 24 is disposed under the plural light sources 23, and movable relative to the casing 21 along the second direction D2. After the plural light beams B are transmitted through the gap G* of the transfer paper M*, the plural light beams B are received by the sensing module 24. Under this circumstance, the purpose of detecting the gap G* is achievable.

Figure 5:
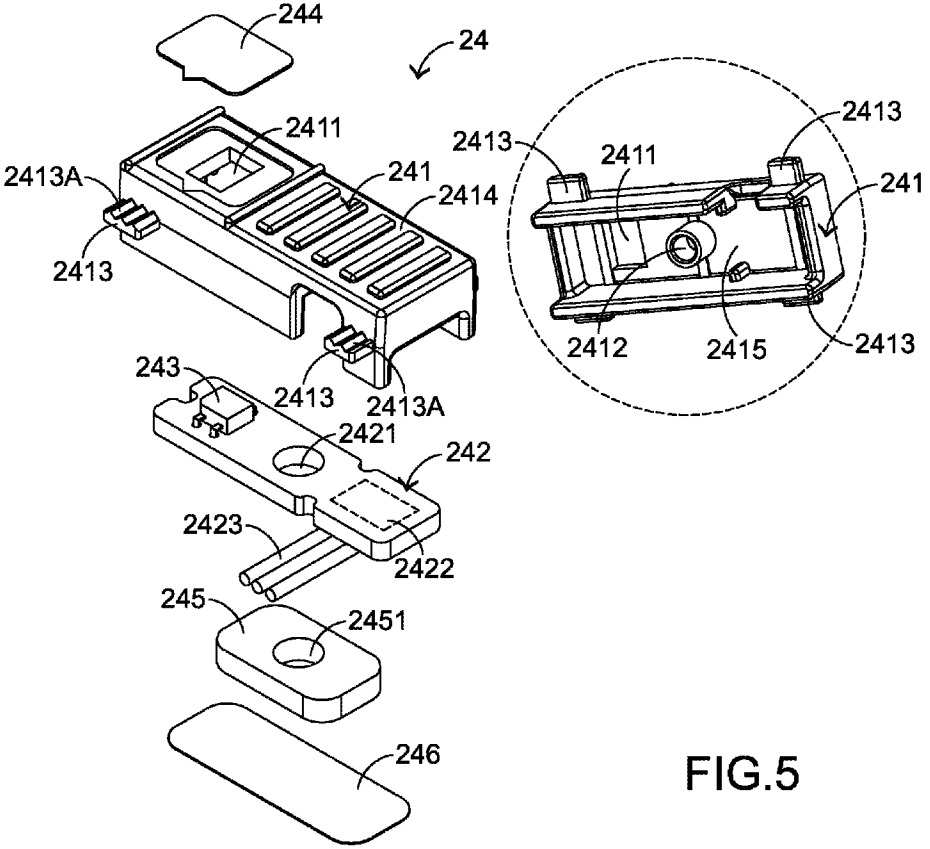
FIG. 5 is a schematic exploded view illustrating a sensing module used in the printing device according to the embodiment of the present invention.

FIG. 5 is a schematic exploded view illustrating a sensing module used in the printing device according to the embodiment of the present invention. As shown in FIG. 5, the sensing module 24 comprises a sensor housing 241, a circuit board 242, a sensing element 243, a protective plate 244, a cushioning element 245, and an anti-abrasive plate 246. The sensor housing 241 comprises a first opening 2411, a fixing post 2412, and plural protrusion blocks 2413. The first opening 2411 is located at a top surface 2414 of the sensor housing 241. The fixing post 2412 is disposed on an inner surface 2415 of the sensor housing 241. The plural protrusion blocks 2413 are externally protruded from the sensor housing 241. Each of the plural protrusion blocks 2413 comprises a first rack structure 2413A. The first rack structure 2413A is disposed on a top surface of the corresponding protrusion block 2413. In this embodiment, the first rack structure 2413A is integrally formed with the corresponding protrusion block 2413. Moreover, the fixing post 2412 and the plural protrusion blocks 2413 are integrally formed with the sensor housing 241.

The circuit board 242 is disposed within the sensor housing 241, and fixed on the sensor housing 241. The circuit board 242 comprises a second opening 2421, a controlling unit 2422, and an electrical wire 2423. The controlling unit 2422 is electrically connected with the sensing element 243. The electrical wire 2423 is connected with an external power source (not shown) for transmitting electricity from the external power source to the circuit board 242. By receiving the electricity, the circuit board 242, the controlling unit 2422 and the sensing element 243 are enabled. The sensing element 243 is disposed on the circuit board 242, and exposed to the first opening 2411. After the plural light beams B transmitted through the gap G* and the first opening 2411 are received by the sensing element 243, the sensing element 243 issues a light intensity value to the controlling unit 2422. In this embodiment, the circuit board 242 is a printed circuit board. The controlling unit 2422 is a firmware component, which is disposed on the circuit board 242 in a firmware burning manner.

The protective plate 244 is disposed on the sensor housing 241 for covering the first opening 2411 in order to protect the sensing element 243. The cushioning element 245 comprises a third opening 2451. In addition, the cushioning element 245 is disposed under the circuit board 242. The fixing post 2412 of the sensor housing 241 is penetrated through the second opening 2421 and the third opening 2451 in order to fix the circuit board 242 and the cushioning element 245 on the sensor housing 241. The anti-abrasive plate 246 is disposed under the cushioning element 245. The anti-abrasive plate 246 is contacted with the slide guiding body 214 in order to avoid excessive friction between the sensor housing 241 and the slide guiding body 214. In this embodiment, the protective plate 244 is a light-transmissible Mylar sheet, the cushioning element 245 is a foam cushion, and the anti-abrasive plate 246 is a Mylar sheet.

Figure 6:
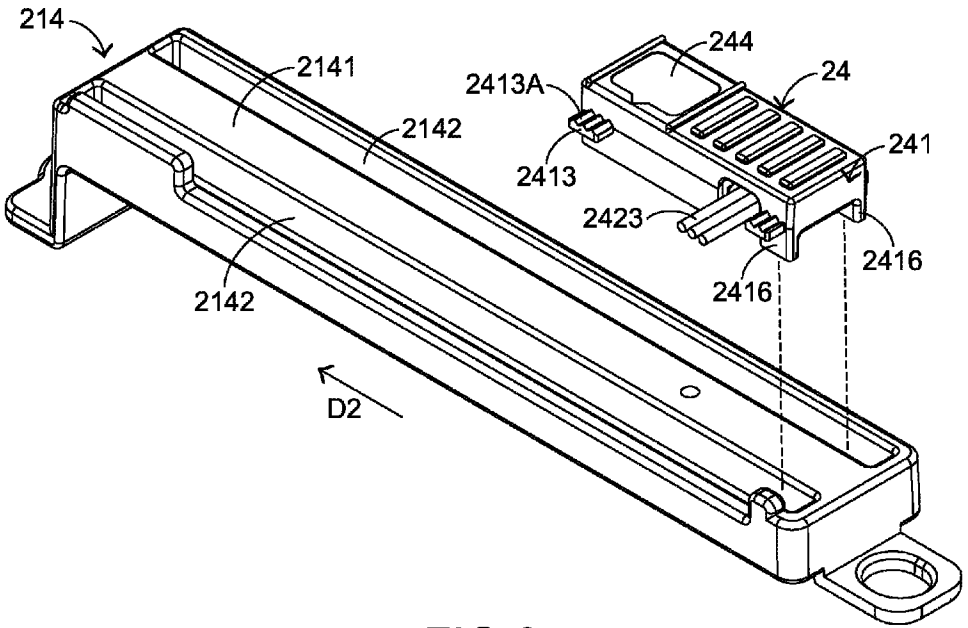
FIG. 6 is a schematic exploded view illustrating the relationship between the sensing module and the slide guiding body of the printing device according to the embodiment of the present invention.

FIG. 6 is a schematic exploded view illustrating the relationship between the sensing module and the slide guiding body of the printing device according to the embodiment of the present invention. In FIG. 6, the outward appearance of an assembled structure of the sensing module 24 and the outward appearance of a guiding track 2141 of the slide guiding body 214 are shown. The slide guiding body 214 comprises two elongated grooves 2142 along the second direction D2. The guiding track 2141 is arranged between the two elongated grooves 2142 and extended along the second direction D2. The guiding track 2141 is contacted with the sensor housing 241 of the sensing module 24, and used for guiding movement of the sensing module 24 along the second direction D2. In this embodiment, the guiding track 2141 and the two elongated grooves 2142 are integrally formed with the slide guiding body 214.

As shown in FIG. 6, the sensor housing 241 of the sensing module 24 is supported by the slide guiding body 214. Moreover, a lower part 2416 of the sensor housing 241 is inserted into the elongated grooves 2142. Consequently, the guiding track 2141 may be contacted with the sensor housing 241.

Figure 7:
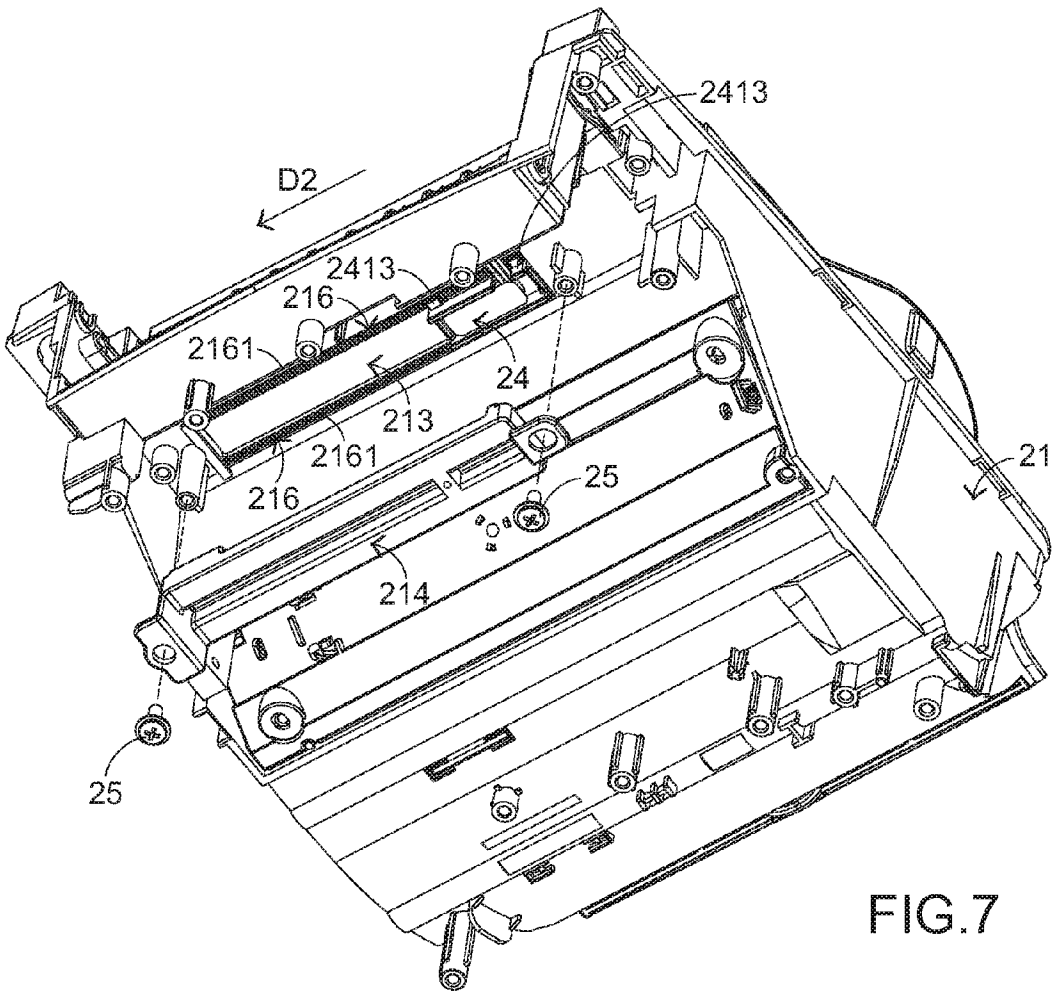
FIG. 7 is a schematic perspective view illustrating the casing of the printing device according to the embodiment of the present invention and taken along another viewpoint.

FIG. 7 is a schematic perspective view illustrating the casing of the printing device according to the embodiment of the present invention and taken along another viewpoint. As shown in FIG. 7, the casing 21 further comprises two stopping elements 216. The two stopping elements 216 are located at two opposed sides of the elongated slot 213, respectively. Each of the stopping elements 216 comprises a second rack structure 2161. The second rack structure 2161 is disposed on an inner surface of a corresponding stopping element 216 and extended along the second direction D2. In addition, the second rack structure 2161 has a saw-toothed shape. On the other hand, the slide guiding body 214 is structurally fixed on the casing 21, and the sensor housing 241 is disposed on the slide guiding body 214. The stopping elements 216 are used for stopping the plural protrusion blocks 2413 of the sensor housing 241 in order to prevent detachment of the sensor housing 241 from the elongated slot 213. In a case that the plural protrusion blocks 2413 are stopped by the stopping elements 216, the first rack structures 2413A are engaged with corresponding second rack structures 2161, so that the sensor housing 241 is securely fixed. In this embodiment, each of the second rack structures 2161 is integrally formed with a corresponding stopping element 216, and the stopping elements 216 are integrally formed with the casing 21. Moreover, the slide guiding body 214 is fixed on the casing 21 by a screwing means through screws 25.

It is noted that numerous modifications and alterations may be made while retaining the teachings of the invention. For example, in some other embodiments, the casing comprises only a single stopping element, and the stopping element is located at a side of the elongated slot. Moreover, the slide guiding body and the stopping element are integrally formed with the casing. That is, an elongated groove of the casing is defined by the elongated slot and the slide guiding body collaboratively. Consequently, the sensing module may be placed on the slide guiding body through the elongated slot.

Figure 8:
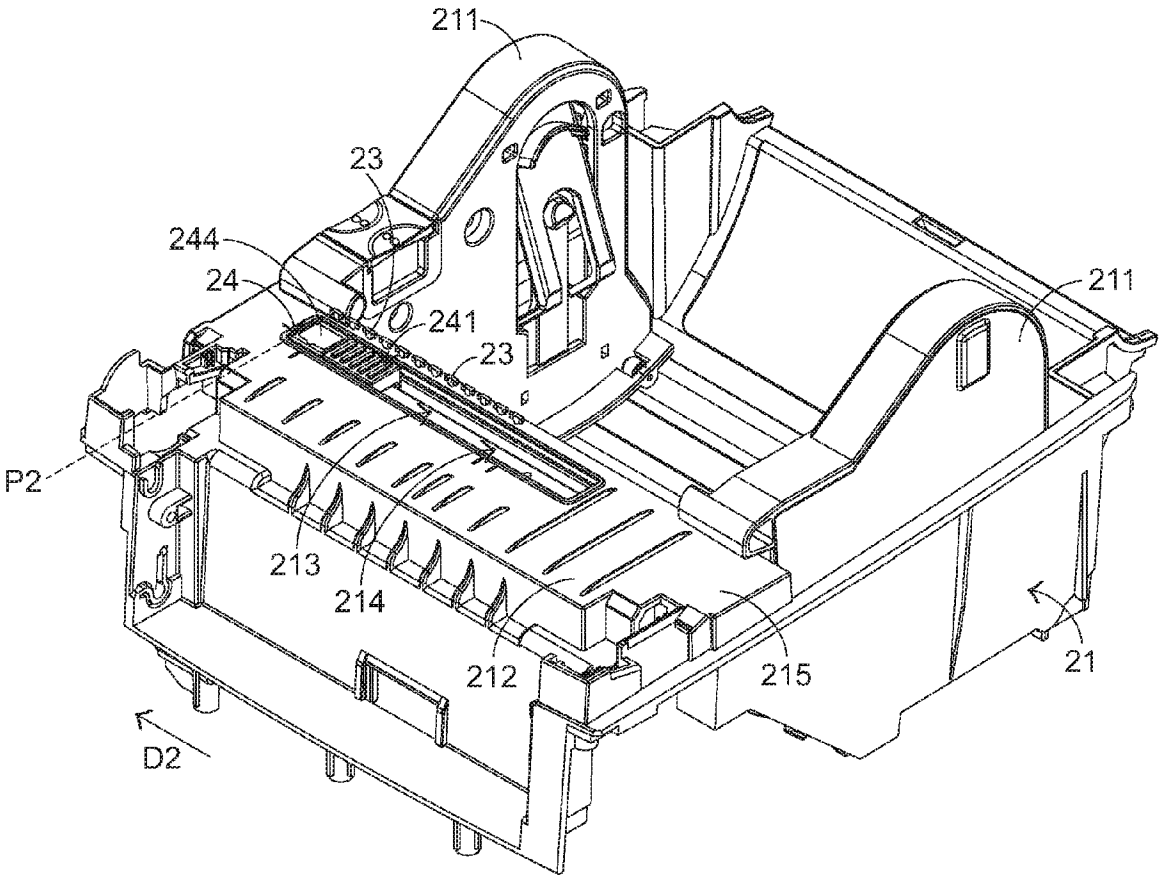
FIG. 8 is a schematic perspective view illustrating a portion of the printing device according to the embodiment of the present invention.

FIG. 8 is a schematic perspective view illustrating a portion of the printing device according to the embodiment of the present invention. For clearly illustrating the relative positions between the plural light sources 23 and the sensing module 24, the upper cover 22 is not shown. From the above discussions, the sensing module 24 is movable within the elongated slot 213 and relative to the casing 21 along the second direction D2 in order to detect the gaps G* of various-sized transfer papers. On the other hand, as shown in FIG. 4, the plural light sources 23 are arranged on the upper cover 22 from the edge 222 of the inner surface 221 of the upper cover 22 to a position beyond the middle point 223 of the inner surface 221. That is, the length of the plural light sources 23 is greater than the length of the elongated slot 213. Consequently, regardless of where the sensing module 24 within the elongated slot 213 is moved, the plural light sources 23 are always disposed over the sensing module 24. In other words, the plural light beams B from the plural light sources 23 can be received by the sensing module 24 without being missed out. Moreover, since it is not necessary to move the plural light sources 23, the mechanism for moving the plural light sources 23 may be omitted.

Figure 9:
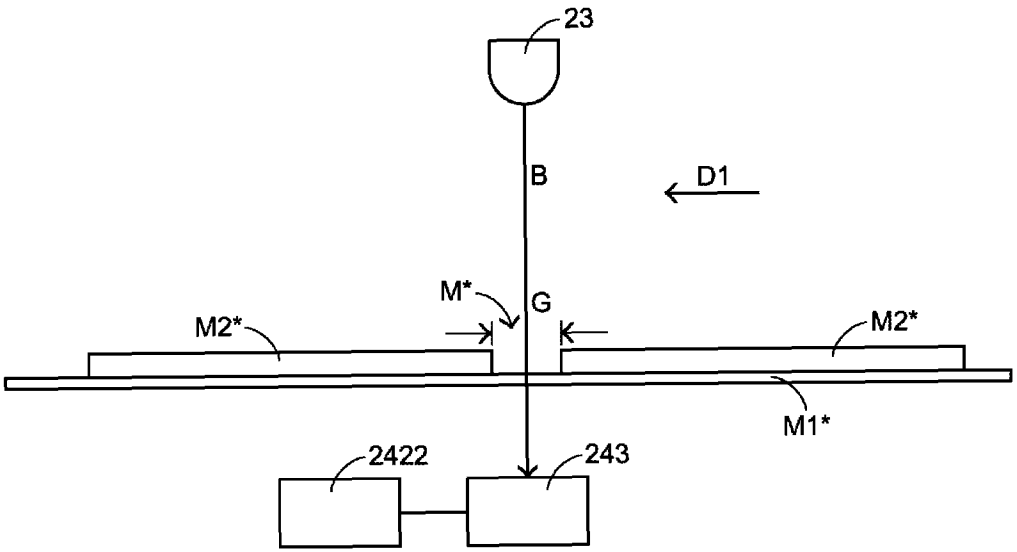
FIG. 9 is a schematic functional block diagram illustrating the sensing module of the printing device for detecting the gap of the transfer paper according to the embodiment of the present invention.

Hereinafter, a method for detecting the gap G* of the transfer paper M* will be illustrated with reference to FIG. 4 and FIG. 9. FIG. 9 is a schematic functional block diagram illustrating the sensing module of the printing device for detecting the gap of the transfer paper according to the embodiment of the present invention. As shown in FIG. 9, a predetermined light intensity range has been previously stored in the controlling unit 2422. After the plural light beams B are received by the sensing element 243, the sensing element 243 issues a light intensity value corresponding to the plural light beams B to the controlling unit 2422. By realizing whether the light intensity value is within the predetermined light intensity range, the controlling unit 2422 may judge whether the gap G* of the transfer paper M* is detected or not. The predetermined light intensity range is previously set. In addition, the predetermined light intensity range is lower than the original light intensity value which is not attenuated, and the predetermined light intensity range is higher than 0.

As shown in FIG. 4, the sensing module 24 is located at a first position P1 of the slide guiding body 214. In a case that the transfer paper M* is outputted and one medium part M2* (e.g. the left-side medium part M2* as shown in FIG. 9) is transferred through the region between the plural light sources 23 and the sensing module 24, the plural light beams B from the plural light sources 23 are blocked by the medium part M2*. Under this circumstance, the plural light beams B fail to be received by the sensing element 243 of the sensing module 24. Since no light intensity value is received, the light intensity value is considered as zero by the controlling unit 2422. Moreover, since the value 0 is not within the predetermined light intensity range, the controlling unit 2422 judges that the gap G* of the transfer paper M* is not detected.

Then, as the transfer paper M* is continuously outputted, the gap G* between the medium part M2* and a next medium part M2* (e.g. the right-side medium part M2* as shown in FIG. 9) is transferred through the region between the plural light sources 23 and the sensing module 24. Consequently, the plural light beams B from the plural light sources 23 are transmitted through the gap G* and the underlying releasing paper part M1*. During the plural light beams B are transmitted through releasing paper part M1*, portions of the plural light beams B are absorbed by the releasing paper part M1*, so that the light intensity value is attenuated. Consequently, the plural light beams B with the attenuated light intensity value are transmitted through the protective plate 244 and received by the sensing element 243. Moreover, the sensing element 243 issues a light intensity value corresponding to the plural light beams B to the controlling unit 2422. Meanwhile, since the light intensity value is within the predetermined light intensity range, the controlling unit 2422 judges that the gap G* of the transfer paper M* is detected. Afterwards, the printing task of the printing device 2 of the present invention can be started.

Furthermore, for printing the image on a larger-sized releasing paper part of the transfer paper, the user needs to manually move the sensing module 24 to a second position P2 of the slide guiding body 214 (see FIG. 8). A process of manually moving the sensing module 24 will be illustrated as follows.

When the sensing module 24 is located at the first position P1, the plural protrusion blocks 2413 of the sensor housing 241 are stopped by the stopping elements 216 of the casing 21. Meanwhile, since the first rack structures 2413A of the plural protrusion blocks 2413 are engaged with corresponding second rack structures 2161 of the stopping elements 216, the sensor housing 241 is securely fixed at the first position P1. For releasing the fixed status of the sensor housing 241, the user may provide a depressing force to the sensor housing 241. The depressing force can be buffered by the cushioning element 245, which is disposed within the sensor housing 241. Moreover, in response to the depressing force, the cushioning element 245 is subjected to deformation. Consequently, the sensor housing 241 is moved downwardly relative to the slide guiding body 214, and the first rack structures 2413A of the plural protrusion blocks 2413 are disengaged from corresponding second rack structures 2161 of the stopping elements 216. Under this circumstance, the fixed status of the sensor housing 241 is released.

Then, the sensor housing 241 is manually pushed by the user. Consequently, the sensor housing 241 is moved relative to the casing 21 to the second position P2 along the second direction D2. During the sensor housing 241 is moved along the second direction D2, the first rack structures 2413A and corresponding second rack structures 2161 are non-periodically contacted with each other. Consequently, at the time when the sensor housing 241 is pushed by the user, the non-periodical contact between the first rack structures 2413A and corresponding second rack structures 2161 may impart a tactile feel to the user. When the sensor housing 241 is moved to the second position P2, the depressing force provided to the sensor housing 241 is eliminated. Under this circumstance, the deformed cushioning element 245 is restored to its original shape. The restored cushioning element 245 is moved upwardly to push the sensor housing 241. Consequently, the sensor housing 241 is moved upwardly relative to the slide guiding body 214. Meanwhile, the first rack structures 2413A and corresponding second rack structures 2161 are engaged with each other. Consequently, the sensor housing 241 is fixed at the second position P2.

In some other embodiments, the plural protrusion blocks and the corresponding stopping elements may be designed to lack the tactile feel according to the practical requirements. Under this circumstance, the stopping elements have no second rack structures, and the plural protrusion blocks have no first rack structures.

In this embodiment, the sensor housing 241 and the slide guiding body 214 are both made of plastic materials. Since the sensor housing 241 and the slide guiding body 214 are made of the plastic materials, as the sensor housing 241 is pressed down and moved along the second direction D2, a frictional force between the sensor housing 241 and the slide guiding body 214 is generated. Due to the frictional force, the sensor housing 241 and the slide guiding body 214 are abraded by each other. Consequently, many plastic scraps are generated. After the sensor housing 241 and the slide guiding body 214 are used for a long time period, the plastic scraps cause non-smooth movement. If the sensor housing 241 and the slide guiding body 214 are seriously abraded, the sensor housing 241 and the slide guiding body 214 are possibly detached from each other. For solving the above drawbacks, the anti-abrasive plate 246 of the sensing module 24 is able to avoid excessive friction between the sensor housing 241 and the slide guiding body 214. In some other embodiments, the sensor housing 241 and the slide guiding body 214 are made of non-plastic materials or any other anti-abrasive materials, and the anti-abrasive plate is exempted from the sensing module.

From the above descriptions, the present invention provides a printing device. The printing device comprises a movable sensing module and a row of plural light sources in order to replace the two movable sensing modules of the conventional printing device. As previously described, during the process of moving the two sensing modules of the conventional printing device, the two sensing modules should be precisely aligned with each other in order to provide normal operations of the two sensing modules. In the printing device of the present invention, the plural light beams emitted by the row of light sources can be projected onto any position of the sensing module. That is, according to the present invention, the movable range of the sensing module is covered by the coverage range of the plural light beams. Since the aligning task of using the conventional printing device is no longer necessary, the printing device of the present invention is capable of detecting the gap of the transfer paper. In other words, the printing device of the present invention is indeed easy-to-use.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A printing device for printing an image on a transfer paper and outputting said transfer paper along a first direction, said printing device comprising:

a casing for accommodating said transfer paper, wherein said transfer paper comprises a releasing paper part and plural medium parts, wherein every two adjacent medium parts are separated from each other by a gap;

an upper cover connected with said casing, wherein said upper cover is rotatable relative said casing, so that said casing is selectively covered or uncovered by said upper cover;

plural light sources disposed on said upper cover and arranged in a row for emitting plural light beams, wherein said plural light sources are arranged along a second direction, which is perpendicular to said first direction, wherein said plural light sources are arranged from an edge of an inner surface of said upper cover to a position beyond a middle point of said inner surface; and a sensing module disposed under said plural light sources and movable relative to said casing along said second direction, wherein after said light beams transmitted through said gap are received by said sensing module, said gap is detected by said sensing module.

2. The printing device according to claim 1, wherein said casing comprises:

an output platform located near an end of said casing;

an elongated slot located at said output platform; and a slide guiding body disposed under said elongated slot for supporting said sensing module, so that said sensing module is inserted into said elongated slot, wherein said slide guiding body comprises a guiding track extended along said second direction, wherein said guiding track is contacted with said sensing module for guiding movement of said sensing module along said second direction.

3. The printing device according to claim 2, wherein said sensing module comprises:

a sensor housing comprising a lower part and a first opening, wherein said lower part of said sensor housing is contacted with said guiding track, and said first opening is located at a top surface of said sensor housing;

a circuit board disposed within said sensor housing and fixed on said sensor housing; and a sensing element disposed on said circuit board and exposed to said first opening, wherein after said plural light beams are transmitted through said gap and said first opening, said plural light beams are received by said sensing element.

4. The printing device according to claim 3, wherein said sensor housing comprises a fixing post, and said circuit board comprises a second opening, wherein said sensing module further comprises:

a protective plate disposed on said sensor housing and covering said first opening, thereby protecting said sensing element; and a cushioning element disposed under said circuit board and comprising a third opening, wherein when a depressing force is exerted on said sensor housing, said depressing force is buffered by said cushioning element, and said cushioning element is compressed and subjected to deformation, so that said sensor housing is moved downwardly relative to said slide guiding body, wherein said fixing post of said sensor housing is penetrated through said second opening and said third opening, so that said circuit board and said cushioning element are fixed on said sensor housing.

5. The printing device according to claim 4, wherein said protective plate is a light-transmissible Mylar sheet, and said cushioning element is a foam cushion.

6. The printing device according to claim 2, wherein said casing further comprises at least one stopping element, wherein said at least one stopping element is located at a side of said elongated slot for stopping said sensing module, thereby preventing detachment of said sensing module from said elongated slot.

7. The printing device according to claim 6, wherein said sensing module comprises a sensor housing, and a lower part of said sensor housing is contacted with said guiding track and movable along said second direction, wherein said sensor housing comprises at least one protrusion block, which is externally protruded from the sensor housing, wherein said at least one protrusion block is contacted with said at least one stopping element, so that said at least one protrusion block is stopped by said at least one stopping element.

8. The printing device according to claim 7, wherein said at least one protrusion block comprises a first rack structure, which is disposed on a top surface of said at least one protrusion block, wherein said at least one stopping element comprises a second rack structure, which is disposed on an inner surface of said at least one stopping element and extended along said second direction, wherein when said at least one protrusion block is stopped by said at least one stopping element, said first rack structure and said second rack structure are engaged with each other, so that said sensor housing is fixed.

9. The printing device according to claim 8, wherein said sensing module further comprises a cushioning element, and said cushioning element is disposed within said sensor housing, wherein when a depressing force is exerted on said sensor housing, said cushioning element is compressed and subjected to deformation, said sensor housing is moved downwardly relative to said slide guiding body, and said first rack structure is disengaged from said second rack structure, so that said sensor housing is moved relative to said casing along said second direction, wherein when said depressing force exerted on said sensor housing is eliminated, said deformed cushioning element is restored to an original shape, said sensor housing is moved upwardly relative to said slide guiding body, and said first rack structure is engaged with said second rack structure, so that said sensor housing is fixed.

10. The printing device according to claim 3, wherein said circuit board comprises a controlling unit, which is connected with said sensing element, wherein a predetermined light intensity range is stored in said controlling unit, wherein after said plural light beams are received by said sensing element, said sensing element issues a light intensity value to said controlling unit, wherein by realizing whether said light intensity value is within said predetermined light intensity range, said controlling unit judges whether said gap of said transfer paper is detected, wherein if said light intensity value is within said predetermined light intensity range, said controlling unit judges that said gap of said transfer paper is detected, wherein if said light intensity value is beyond said predetermined light intensity range, said controlling unit judges that said gap of said transfer paper is not detected.

* * * * *